US005725005A

United States Patent [19]

Yamasaki et al.

[11] Patent Number: 5,725,005

[45] Date of Patent: Mar. 10, 1998

[54] WALKING ASSISTANCE CRUTCH

[75] Inventors: Takuya Yamasaki, Kochi; Keizo Ohta, Okayama, both of Japan

[73] Assignee: Ohta Inc. (Ohta Kabushiki Kaisha), Okayama, Japan

[21] Appl. No.: 602,688

[22] Filed: Feb. 16, 1996

Related U.S. Application Data

[63] Continuation of Ser. No. 331,361, Oct. 27, 1994.

[30] Foreign Application Priority Data

Nov. 4, 1993 [JP] Japan ..... 5-275348

[51] Int. Cl.[6] ..... A61H 3/02

[52] U.S. Cl. ..... 135/73; 135/65; 135/68; 135/71; 135/72

[58] Field of Search ..... 135/65, 68, 71, 135/72, 73

[56] References Cited

U.S. PATENT DOCUMENTS

| | | | |
|---|---|---|---|
| 1,311,664 | 7/1919 | Pearl | 135/73 |
| 2,362,642 | 11/1944 | Lamb | 135/73 |
| 2,417,171 | 3/1947 | McGowan | 135/73 |
| 2,442,896 | 6/1948 | Joseph | 135/73 |
| 2,630,128 | 3/1953 | Slater | 135/73 |
| 2,736,330 | 2/1956 | Wood | 135/73 |
| 2,788,793 | 4/1957 | Abbott | 135/73 |
| 3,150,672 | 9/1964 | Johnson, Jr. | 135/73 |
| 3,304,946 | 2/1967 | Lutes | 135/73 X |
| 4,637,414 | 1/1987 | Urban | 135/73 |

FOREIGN PATENT DOCUMENTS

| | | | |
|---|---|---|---|
| 0681218 | 10/1952 | United Kingdom | 135/73 |

*Primary Examiner*—Wynn E. Wood
*Attorney, Agent, or Firm*—Koda and Androlia

[57] ABSTRACT

According to the present invention, there is provided a walking assistance crutch which is comfortable to use, and which can keep a user from falling on his face by its existence even if he falls down by accident.

Features in structure of the crutch according to the invention are as follows. More specifically, the crutch comprises a crutch main body including an armpit rest at its upper end, a foot portion at its lower end, and a handle grip at its intermediate portion. A vertical length or width W of the armpit rest is increased, and a portion of the armpit rest to be held beneath a shoulder of a user is formed to have a substantially triangular cross section so that it has curved surfaces which conform with contours of an inner side of an upper arm and a breast side wall of the user. Also, the armpit rest is formed to have the curved surfaces which extend substantially in conformity with the contours of the inner side of the upper arm and the breast side wall of the user, and front and rear portions of the armpit rest are formed larger than the portion to be held beneath the shoulder of the user. The handle grip is extended forwardly from a phantom line extending between the armpit rest and the foot portion.

8 Claims, 17 Drawing Sheets

WALKING ASSISTANCE CRUTCH

This is a continuation of application Ser. No. 08/331,361, filed Oct. 27, 1994.

BACKGROUND OF THE INVENTION

1. Industrial Field of the Invention

This invention relates to a walking assistance crutch which is suitable for use by a physically handicapped person having an impediment in walking.

2. Description of the Prior Art

A crutch for assistance in walking typically comprises a crutch main body, an armpit rest portion at an upper end of the crutch main body, a food portion at the lower end and a handle grip at the intermediate portion. The crutch is intended for use by a person having difficulty in walking due to cerebral apoplexy, bone fracture resulting from an accident or the like. Conventionally, the crutch is designed such that its upper end portion extending to an armpit of a user is held beneath the shoulder of the user when he uses the crutch for walking, in order to increase stability in shifting his weight to the handle grip. In this connection, the conventional crutch has an armpit rest portion having a small thickness enough to be firmly held beneath the shoulder of the user because he needs to hold the armpit rest beneath the shoulder. The weight is not be rested on the small-thickness armpit rest portion to such an extent that the armpit or breast side wall is strongly pressed. The armpit rest portion is usually held beneath the shoulder of the user in a state that it is separated downwardly from the armpit of the user at an interval of several centimeters.

In the conventional crutch, it is thus necessary for the user to tightly hold the thin armpit rest portion between the upper arm and the breast side beneath the shoulder in order to increase stability in walking. This type of crutch has been disclosed in, for example, U.S. Pat. No. 2,630,128 or 2,788,793. According to the conventional structure, the crutch may be unstable during walking and the user may have difficulty in walking even with the crutch. Further, the skin at both the inside area of the arm and the side body which hold the thin armpit rest portion is sometimes grazed because the armpit rest portion needs to be held firmly, which inevitably causes pain to the user.

Taking the problems of the prior art into account, the present invention aims to provide a crutch for a physically handicapped person which is comfortable to use. According to the present invention, there is also provided a crutch having a structure which can protect a user from striking his face against the ground or the like by the existence of the crutch when the user falls down by accident.

SUMMARY OF THE INVENTION

To solve the above-mentioned problems, the present invention is structured as follows.

That is to say, according to the invention, there is provided a walking assistance crutch comprising a crutch main body including an armpit rest at its upper end, a foot portion at its lower end, and a handle grip at its intermediate portion, in which the armpit rest is formed to have curved surfaces which respectively contact in conformity with contours of an inner side of an upper arm above an elbow and a breast side wall of a user when he holds the armpit rest beneath his shoulder, and the armpit rest is made of soft material so that it comfortably supports the body of the user. More specifically, the armpit rest has a large vertical length or width W and a portion thereof to be held beneath the shoulder of the user is formed to have a substantially triangular cross section. The surfaces of the armpit rest which contact with the upper arm and the breast side wall of the user are formed to extend substantially in conformity with the contours of the inner side of the upper arm and the breast side wall. Front and rear portions of the armpit rest are larger than the portion to be held beneath the shoulder of the user.

Further, the armpit rest includes the curved surfaces which substantially fit with the contours of the inner side of the upper arm and the breast side wall, and the front and rear portions of the armpit rest are larger than the portion to be held beneath the shoulder of the user. In the armpit rest, the front portion may be formed larger than the rear one. In the walking assistance crutch which has various structures described above, the inventors of the present invention have developed such structure that the handle grip is extended forwardly from a phantom line extending between the armpit rest and the foot portion.

The crutch main body is supported at its upper end by the armpit rest such that it can pivot backward and forward. The crutch main body may be provided with a pad between the armpit rest and the handle grip. Further, the crutch main body may be telescopic in order to attain using facility.

With the foregoing structures, there can be obtained functions and effects which will be described below.

Because the vertical length or width W of the armpit rest is so increased that the armpit rest may comfortably contact with the upper arm and the breast side wall of the user in conformity with the contours thereof, the armpit rest contacts with the upper arm and the breast side wall over wide areas thereof. As a result, the body of the user is kept from being pressed locally by the armpit rest. Further, thanks to the substantially triangular cross section of the portion of the armpit rest to be held beneath the shoulder of the user, the user can impose his weight on the crutch more comfortably by holding the armpit rest between his upper arm and breast side wall.

Since the armpit rest has the curved surfaces which contact substantially in conformity with the contours of the inner side of the upper arm and the breast side wall of the user, the armpit rest softly fits with the body, which hardly causes pain to the user during use of the crutch. The front and rear portions of the armpit rest are formed larger than the portion thereof to be held beneath the shoulder. Because the front portion is formed larger, it is easier for the user to impose his weight on the crutch during a rest while he is standing, and because the rear portion is formed larger and wider in a lateral length, the armpit rest rarely slips out from the armpit during usual use.

When the front portion of the armpit rest is formed larger than the rear portion thereof, the crutch (armpit rest) seldom slips out rearwardly. Even if the user falls forwardly by accident, he can thus slip out the crutch forwardly from the armpit, so that his hand which held the crutch becomes free to support his body on his hands without falling down against the ground (floor or the like).

In the case where the handle grip is extended forwardly from a phantom line extending between the armpit rest and the foot portion, the crutch itself gets a propulsive force. The previously-described various structures of the crutch in addition to the above one give the user more secure balance in use of the crutch, and hardly cause pain to the user.

With the structure that the upper end of the crutch main body is pivotally supported by the armpit rest, the armpit rest does not follow the inclination of the crutch main body when the crutch is being used. The user can walk while the armpit rest is stationarily held between the breast side wall and the upper arm of the user. Therefore, the user suffers from no pain.

With the structure that the pad is provided between the armpit rest and the handle grip, when the user tightly presses the upper arm against the breast side wall in order to securely hold the armpit rest beneath his shoulder, the crutch can be held stably without causing pain to the portions of the body contacting with the crutch. Particularly, by forming the pad to have a smoothly curved surface which extends in conformity with the contour of an inner side of the forearm, the pain can be suppressed more effectively. Further, if the pad is partly curved to form an elbow rest, the crutch can be used more comfortably.

It is needless to say that the length of the crutch can be adjusted in accordance with the height of the user due to the telescoping function of the crutch main body.

BRIEF DESCRIPTION OF THE DRAWINGS

FIG. 13(*b*) is an enlarged side elevational view of the same;

DETAILED DESCRIPTION OF THE INVENTION

Referring to FIGS. 1 to 5, a walking assistance crutch according to the present invention comprises a straight crutch main body 1 including an armpit rest 2 at its upper end, a foot portion 3 at its lower end and a forwardly-projecting handle grip 4 at its intermediate portion.

Figure 5:
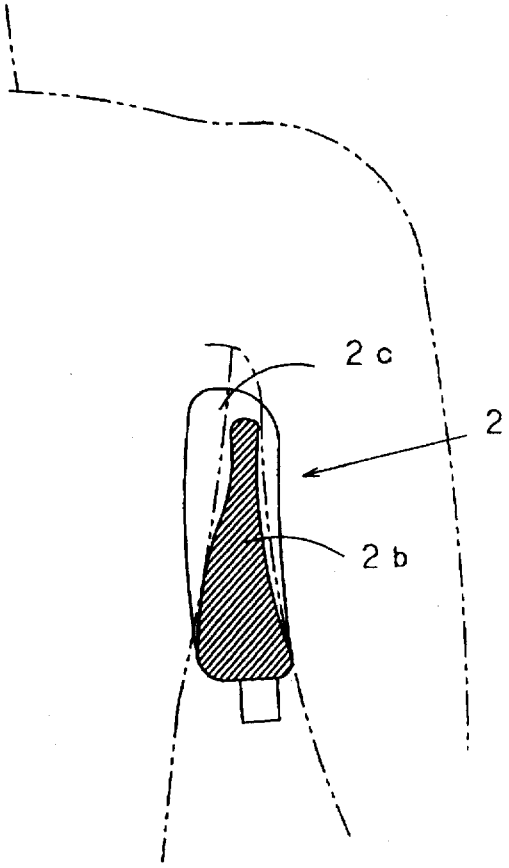
FIG. 5 is a cross-sectional view of the armpit rest when the crutch is being used, taken along a line I—I of FIG. 1 or 2.

The armpit rest 2 has a vertical length or width W larger than that of a conventional walking assistance crutch. In case of the conventional crutch, the armpit rest is longitudinally elongated; a horizontal length L thereof is about 20 cm while a vertical length or width W thereof is about 5 cm. In the walking assistance crutch according to this embodiment of the invention, the armpit rest 2 has a substantially square shape, as viewed from the side. A horizontal length L of the armpit rest is about 17 cm, and a vertical length or width W thereof is about 13 cm. Accordingly, the armpit rest contacts with an upper arm and a breast side wall of a user over vertically wide areas thereof. FIG. 5 shows in cross section a portion 2*b* of the armpit rest 2 which is held beneath the shoulder of the user. As shown in FIG. 5, the portion 2*b* has a generally triangular cross section. For the reasons, when applying force to the crutch in such a manner that the armpit rest is held between the upper arm and the breast side wall with an interval of several centimeters remained between the armpit and the armpit rest, the crutch can support the user more comfortably than the conventional one.

Figure 6:
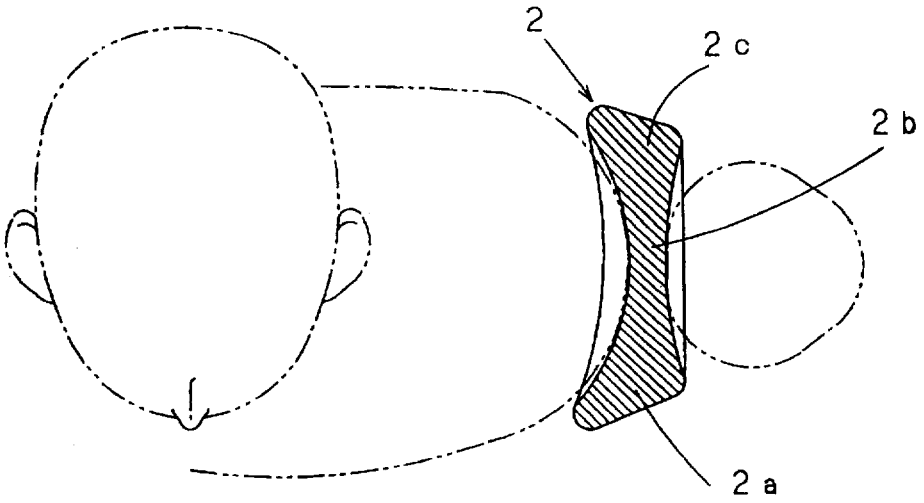
FIG. 6 is a cross-sectional view of the armpit rest when the crutch is being used, taken along a line II—II of FIG. 1 or 2.

Further, as shown in FIG. 6, the armpit rest 2 includes the portion 2*b* to be held beneath the shoulder, a front portion 2*a* and a rear portion 2*c* which are larger than the portion 2*b* and formed to have curved surfaces in conformity with contours of an inner side of the upper arm and the breast side wall. Because the front portion 2*a* is formed to have a lateral length larger than that of the portion 2*b* to be held beneath the shoulder or to be enlarged, the crutch hardly slips out rearwardly during normal use. The same thing may be said of the rear portion 2*c*. Therefore, the crutch is generally difficult to slip out during the usual use so that it gives the user more secure balance in its use.

Figure 7:
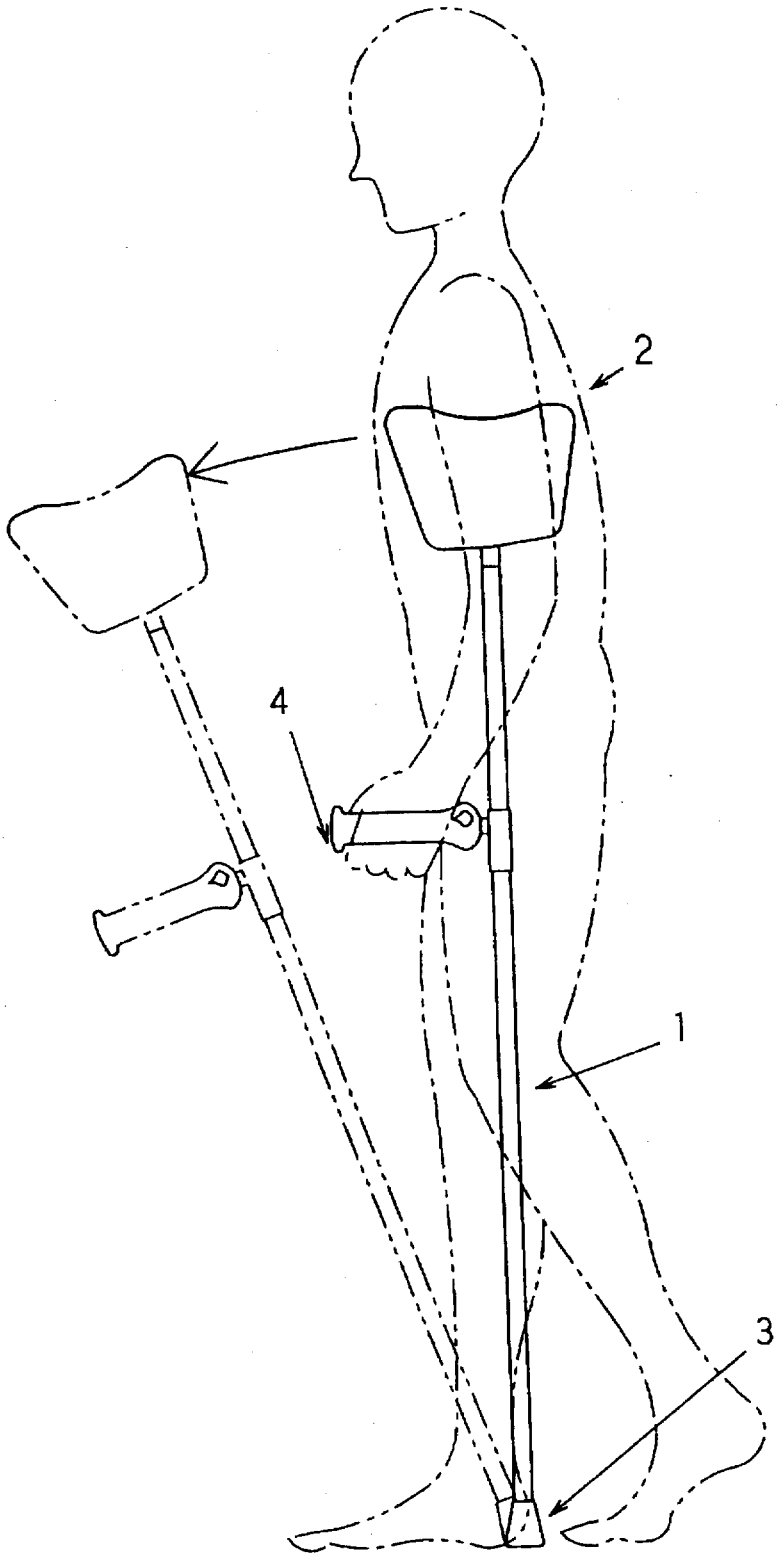
FIG. 7 is a side elevational view of the crutch when it is being used by a physically handicapped person.

In the illustrated embodiment, the armpit rest 2 is arranged such that the front portion 2*a* is formed larger than the rear portion 2*c*, as shown in FIG. 6. When the user falls forwardly by accident, he can slip out the crutch forwardly from the armpit as indicated by an alternate long and two short dashes line in FIG. 7, so that his hand which held the crutch becomes free to support his body on his hands and knees against the ground. It is thus possible to prevent such an accident that the user directly falls on his face against the ground or the like. It is of course necessary that the user receives an explanation concerning the above operation before he begins to use the crutch or he comprehends the operation by reading the operating manual, similarly to the conventional crutch.

Figure 1:
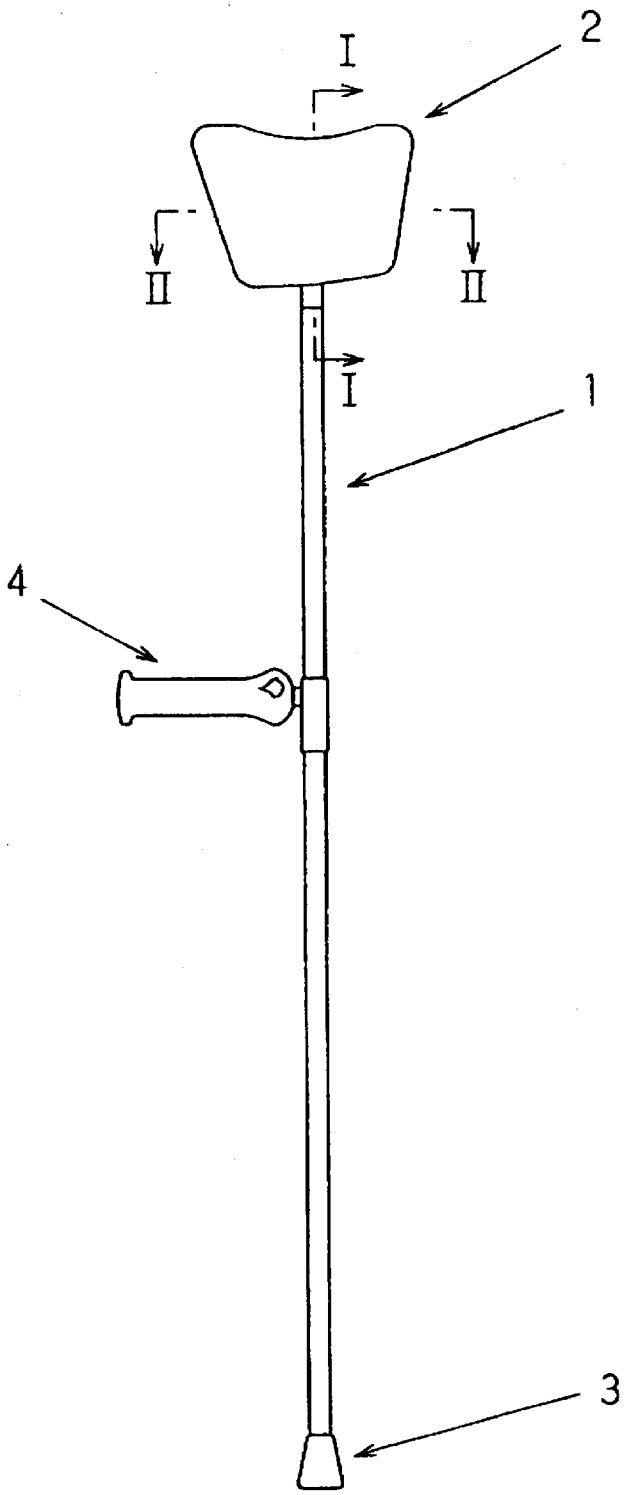
FIG. 1 is a side elevational view of a walking assistance crutch according to a first embodiment of the present invention.
Figure 2:
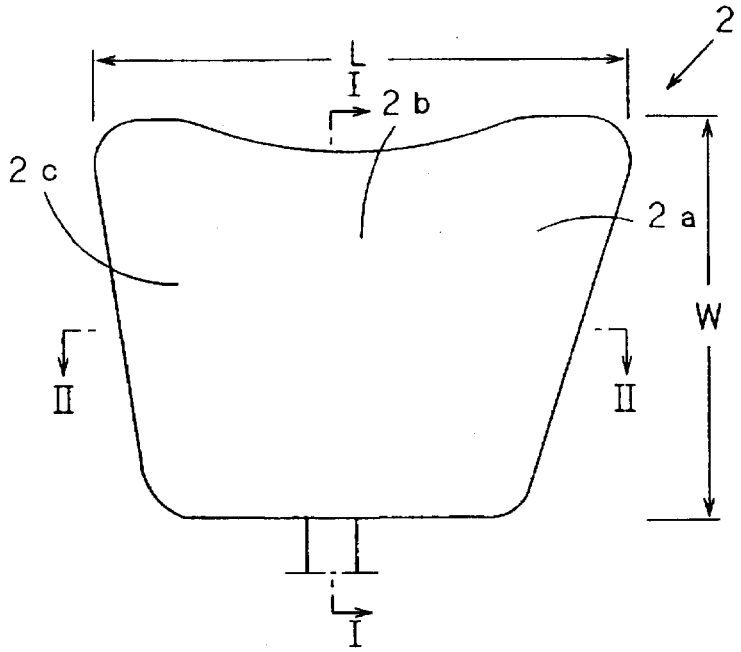
FIG. 2 is an enlarged side elevational view of an armpit rest of the crutch.
Figure 3:
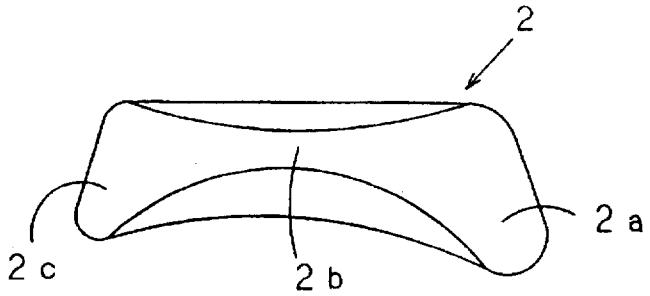
FIG. 3 is a plan view of the armpit rest.
Figure 4:
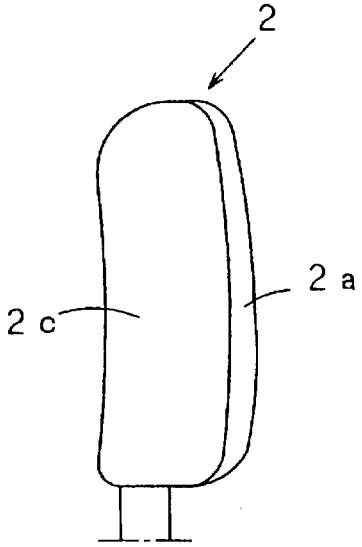
FIG. 4 is a rear elevational view of the armpit rest.
Figure 8:
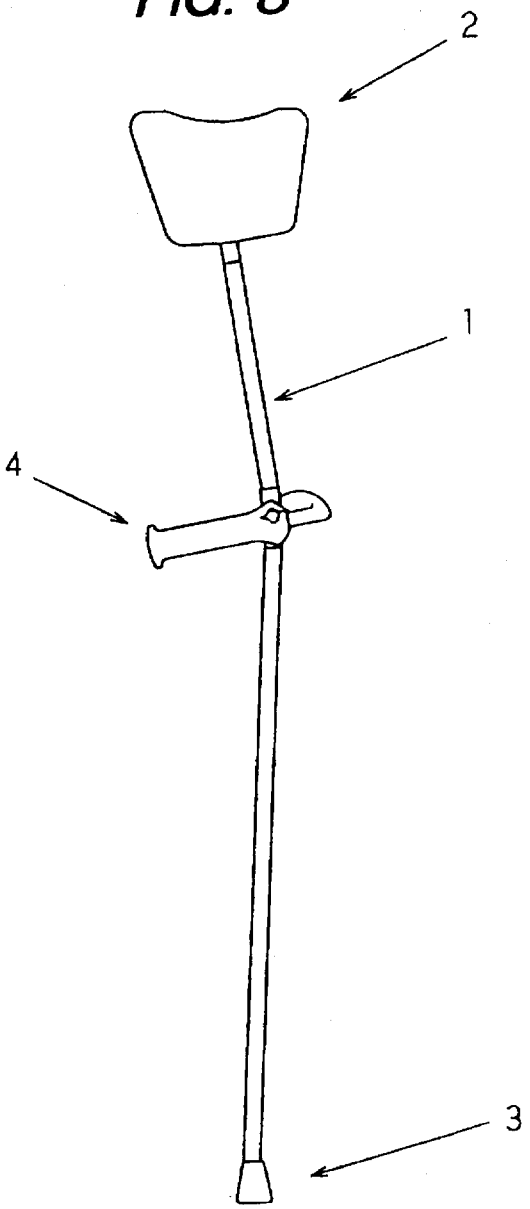
FIG. 8 is a side elevational view of a walking assistance crutch according to a second embodiment of the invention.
Figure 12:
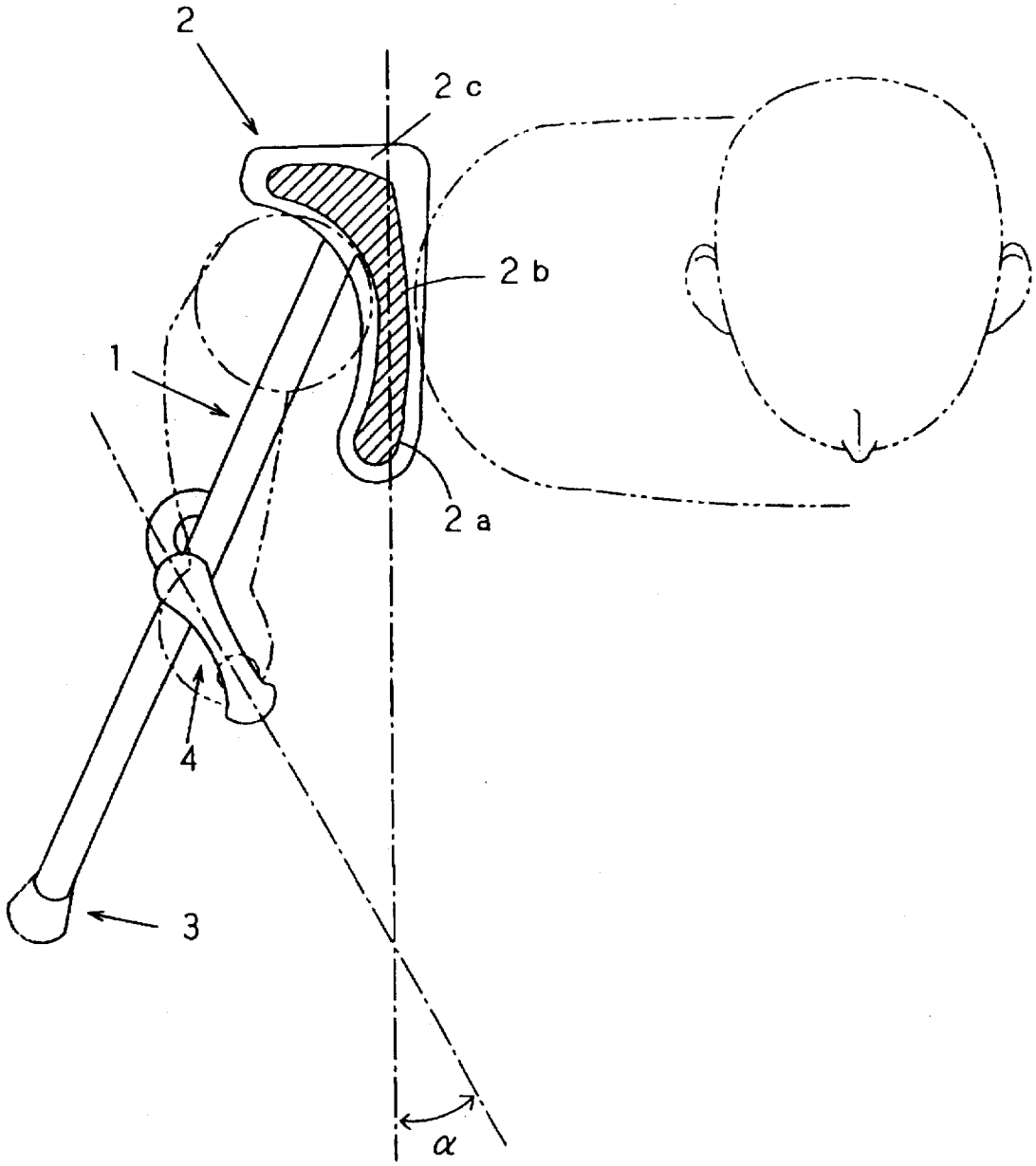
FIG. 12 is a plan view of the crutch according to the third embodiment of the invention when it is being used, an upper portion of which is cut away.
Figure 13A:
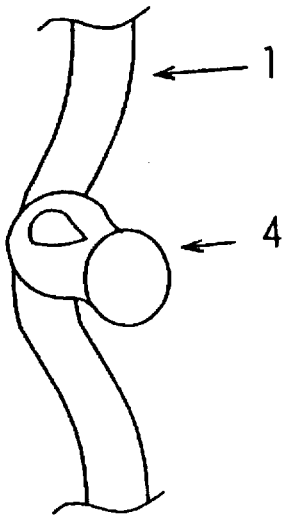
FIG. 13(*a*) is an enlarged front view of a handle grip of the crutch shown in FIG. 11.
Figure 13B:
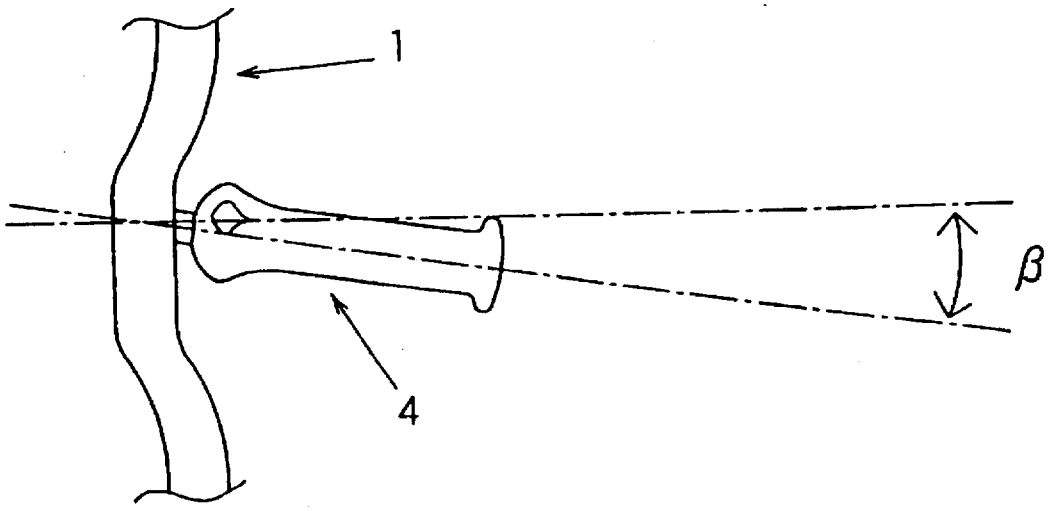

As clearly seen from FIG. 1, the handle grip 4 is extended forwardly from a phantom line extending between the armpit rest 2 and the foot portion 3 in the illustrated embodiment. Also in a second embodiment shown in FIG. 8 in which a crutch main body 1 is bent rearwardly, a handle grip 4 can be similarly extended forwardly from a phantom line extending between an armpit rest and a foot portion. Further, the handle grip 4 can be embodied in various forms such that the handle section 4 is directly projected forward from the crutch main body 1, and a curved portion is formed on a side of the crutch main body, from which the handle grip is projected forwardly as in the second embodiment. If the handle grip in each example is extended forwardly inwardly, as shown in FIGS. 12 and 13, it is easier for the user to grasp the handle grip.

Figure 9:
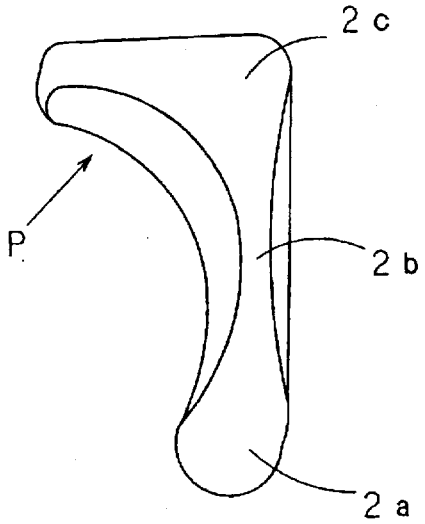
FIG. 9 is a plan view of an armpit rest of a crutch according to a third embodiment of the invention.

FIG. 9 illustrates a third embodiment in which a rear portion 2*c* of an armpit rest 2 is large. When the rear portion 2*c* is much larger than a portion 2*b* to be held beneath the shoulder, the user can use the crutch with less force applied to the portion 2*b* to be held beneath the shoulder. As shown in FIG. 12 which partly illustrates in cross section a shape of the armpit rest 2, the armpit rest 2 forms a surface having such a curvature as to fit the outer peripheral surface or curvature of the upper arm so that the user can walk with ease.

Figure 10:
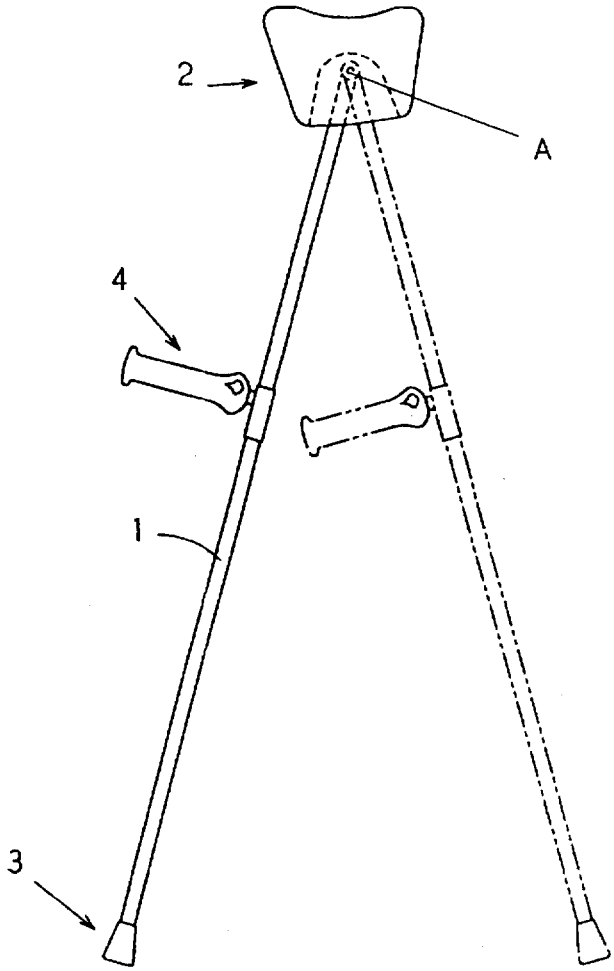
FIG. 10 is a side elevational view of a crutch according to a fourth embodiment of the invention.

As shown in FIG. 10, in each of the walking assistance crutches according to the foregoing embodiments in which the armpit rest 2 is supported at the top end of the crutch main body 1, the crutch main body 1 may be pivotable about a rotational center point A. With the structure, because the armpit rest does not follow the inclination of the crutch main body upon use of the crutch, the user can walk under a condition that the armpit rest is stationarily held between the upper arm and the breast side wall of the user. Therefore, the crutch can realize comfortable walking of the user without causing pain to him.

Figure 11:
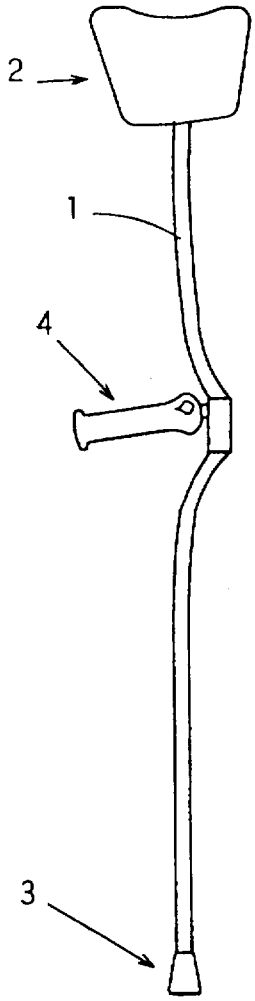
FIG. 11 is a side elevational view of a crutch according to a fifth embodiment of the invention.

FIG. 11 shows an example in which a crutch main body 1 comprises upper and lower shanks connected to each other at a handle grip 4. In the illustrated embodiment, lower and upper end portions of the upper and lower shanks are curved and the handle grip 4 is projected forwardly from the connected portion between the upper and lower shanks. As shown in FIG. 12, when the handle grip 4 extends inwardly (at an angle $\alpha$), a foot portion 3 of the crutch main body can be easily directed outwardly, which enables the user to walk comfortably. Also in the case where the handle grip is extended slightly downwardly (at an inclination angle $\beta$) as shown in FIG. 13(*a*) which is an enlarged front view of the handle grip and FIG. 13(*b*) which is a side elevational view of the same, the user can walk more easily.

Figure 14:
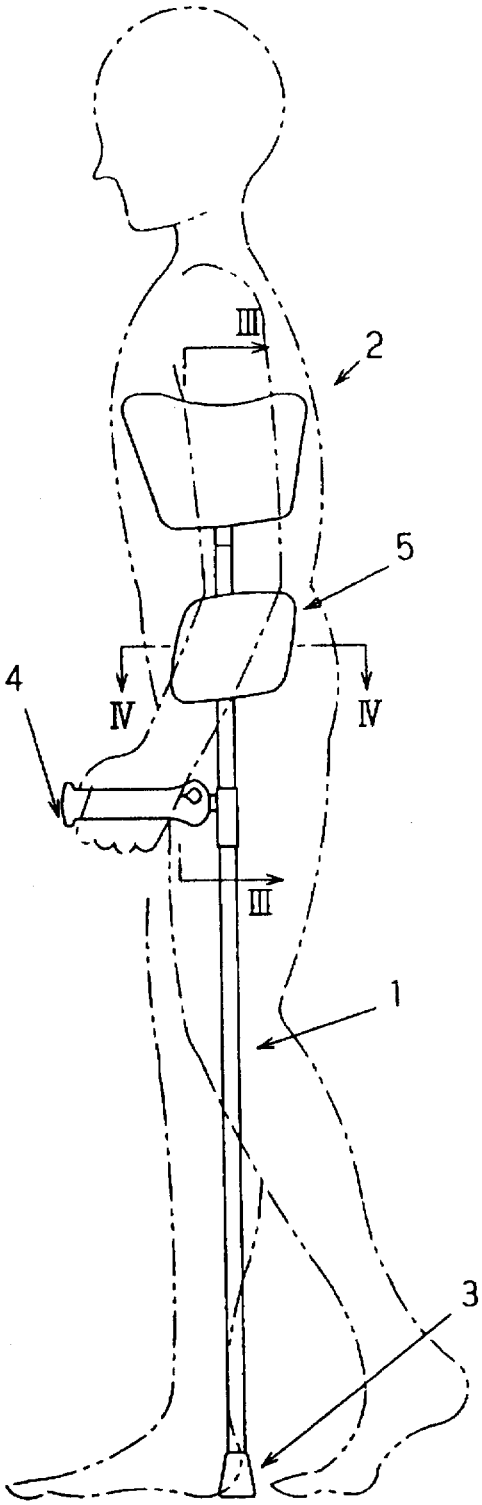
FIG. 14 is a side elevational view of the walking assistance crutch which is provided with a pad.
Figure 15:
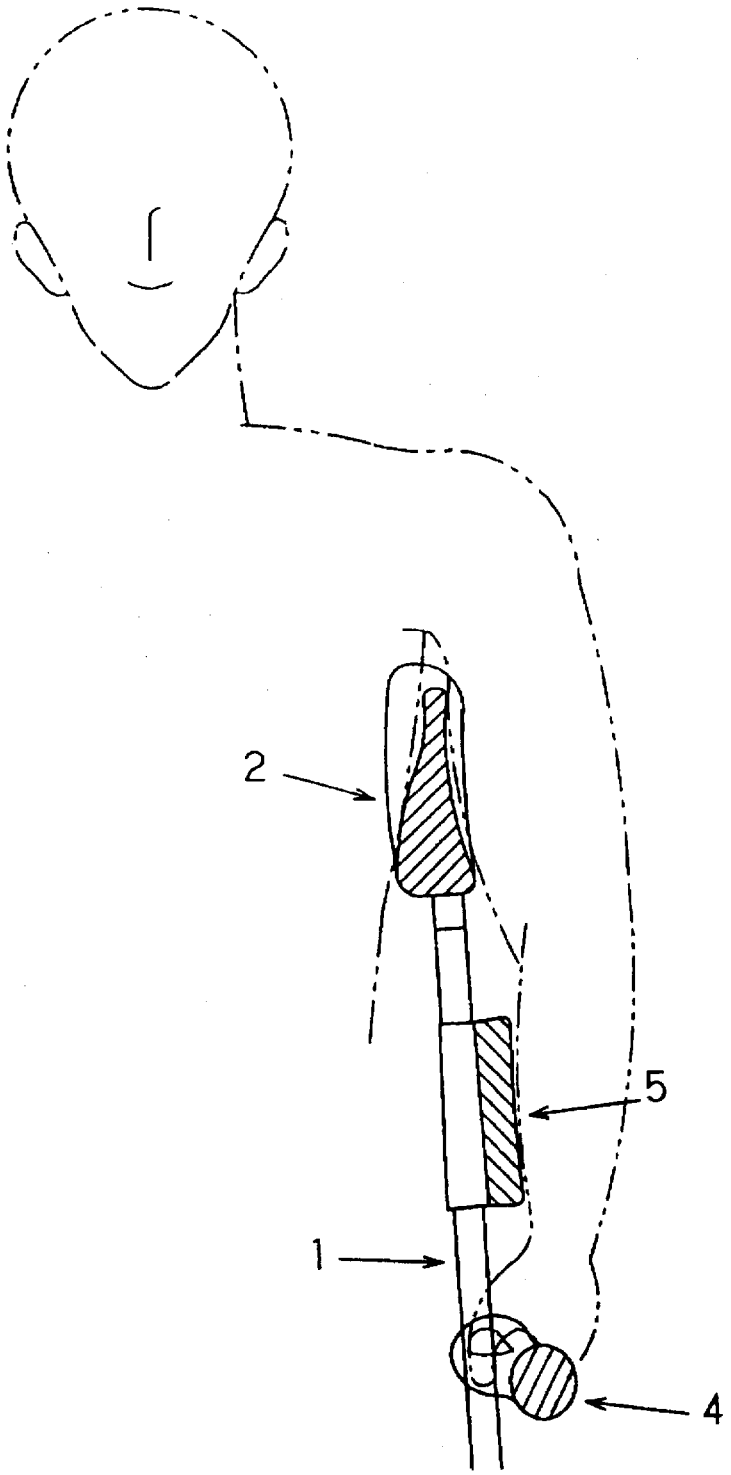
FIG. 15 is a cross-sectional view of the crutch taken along a line III—III of FIG. 14.
Figure 16A:
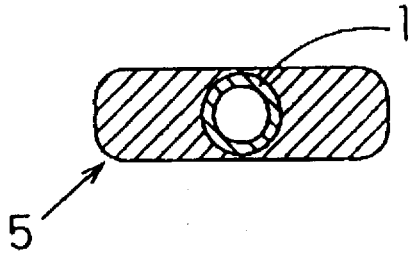
FIGS. 16(*a*) to 16(*c*) are cross-sectional views which illustrate various shapes of the pads, taken along a line IV—IV of FIG. 14.
Figure 16B:
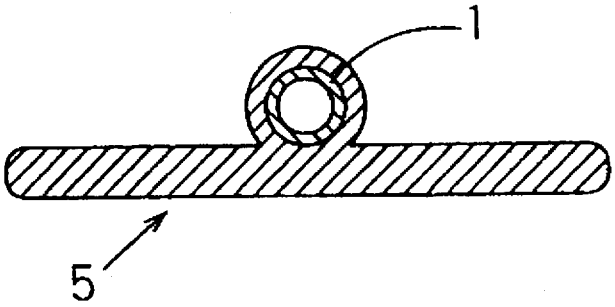
Figure 16C:
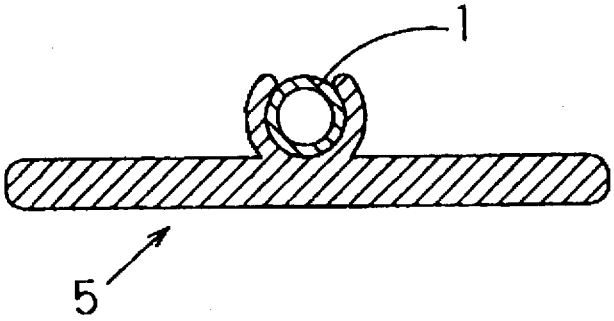

FIGS. 14 to 16 illustrate a modified example of the first embodiment of the invention in which a pad 5 is provided between the armpit rest 2 and the handle grip 4. The pad 5 preferably has a substantially square or rhombic shape as viewed from the side face which contacts with the arm. FIGS. 16(*a*) to 16(*c*) are cross-sectional views each showing the pad, taken along a line IV—IV of FIG. 14. The pad may be formed in a plate-like shape through which the crutch main body extends at the center, as shown in FIG. 16(*a*). Alternatively, the pad may include a holder through which the crutch main body extends as shown in FIG. 16 (*b*), or a holder which can press-fit on the crutch main body as shown in FIG. 16(*c*). Further, when the pad is formed to have surfaces which conform with the contours of an inner side of the forearm of the user or when an outer surface of the pad adjacent to the arm is curved to form an elbow rest, the user can hold the crutch comfortably.

Figure 17:
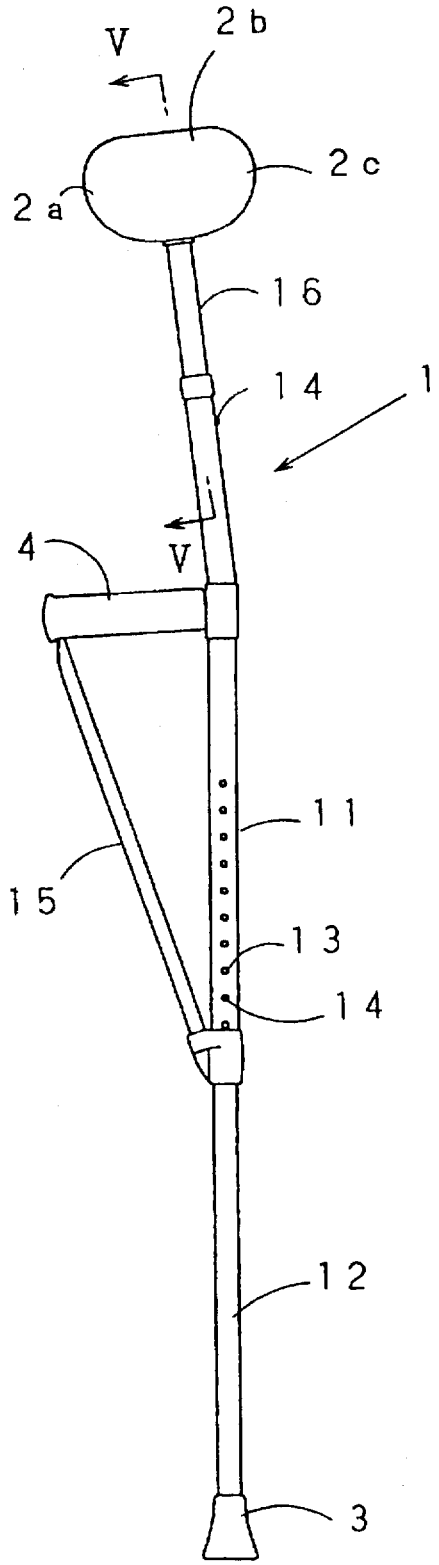
FIG. 17 is a side elevational view of a crutch according to a sixth embodiment of the invention.

FIGS. 17 to 21 show a crutch according to a sixth embodiment of the invention. The crutch is lightweight because it is made of aluminum alloy, and it is of the telescopic type in pursuit of facility of use and storage. More specifically, as shown in FIG. 17, there is provided at a middle portion of a crutch main body 1 an outer tube 11 of a thick pipe in which an inner tube 12 is inserted to be extensible downwardly. The outer tube 11 has a pair of rows of position fixture holes 13 therethrough which are spacedly provided along an axis of the tube, the holes in pair being extended diametrically opposite to each other. The inner tube 12 includes engagement pins 14 to engage with the position fixture holes 13 which are projected from the interior of the inner tube by spring force, in order to adjust the length of the crutch. Additionally, a support bar 15 is provided for reinforcement of an attachment portion between a handle grip 4 and the crutch main body 1.

Figure 18:
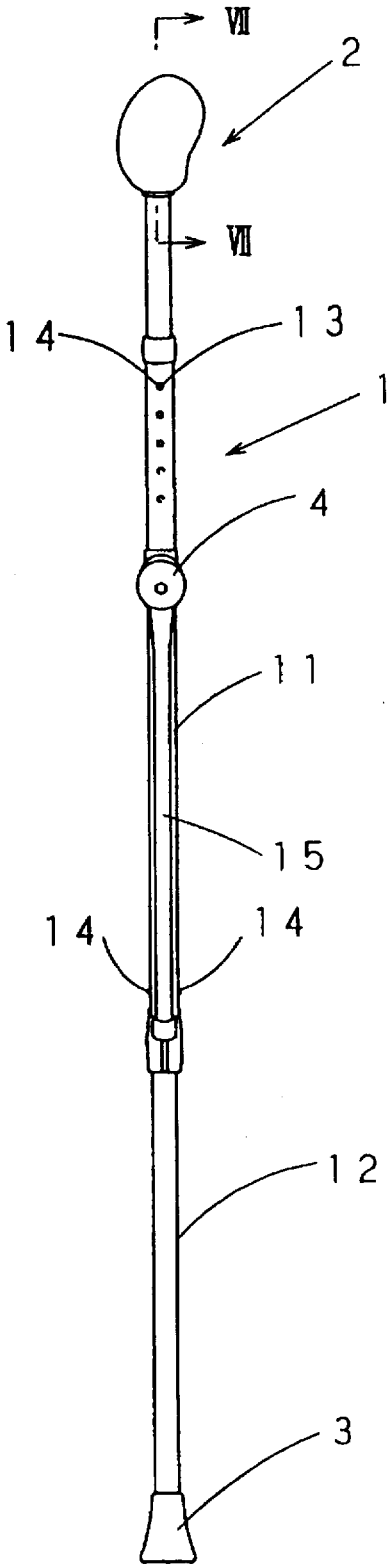
FIG. 18 is a front view of a pair of the crutches of FIG. 17.

The outer tube 11 is bent at its upper portion slightly forwardly. This bent portion of the outer tube 11 is also provided with position fixture holes 13, as shown in FIG. 18. An inner tube 16 is telescopically inserted in the outer tube 11, for adjusting the height of an armpit rest 2. The inner tube 16 can be sufficiently supported even if the position fixture holes 13 are spacedly provided in a row along the axis of the outer tube.

Figure 19:
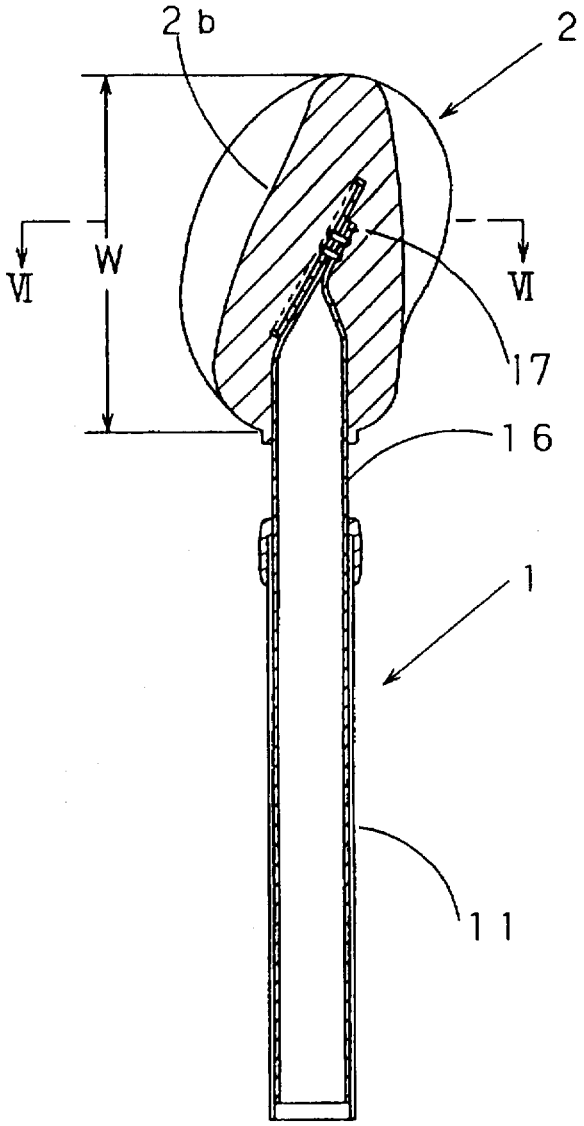
FIG. 19 is an enlarged cross-sectional view of the crutch, taken along a line V—V of FIG. 17.
Figure 20:
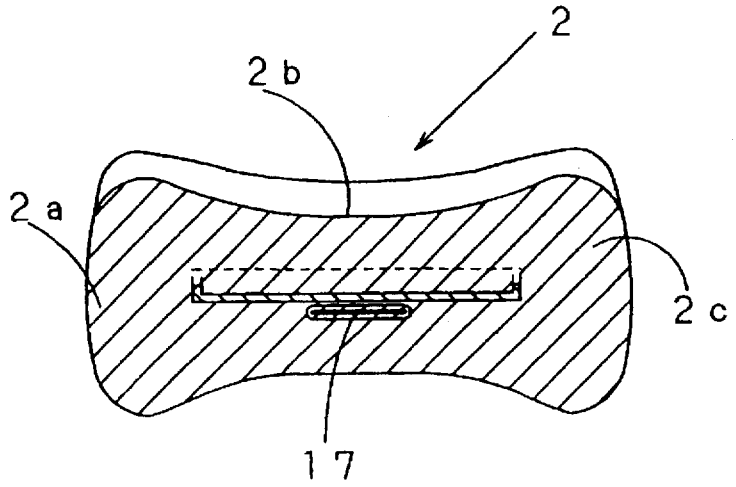
FIG. 20 is a cross-sectional view of an armpit rest, taken along a line VI—VI of FIG. 19.
Figure 21:
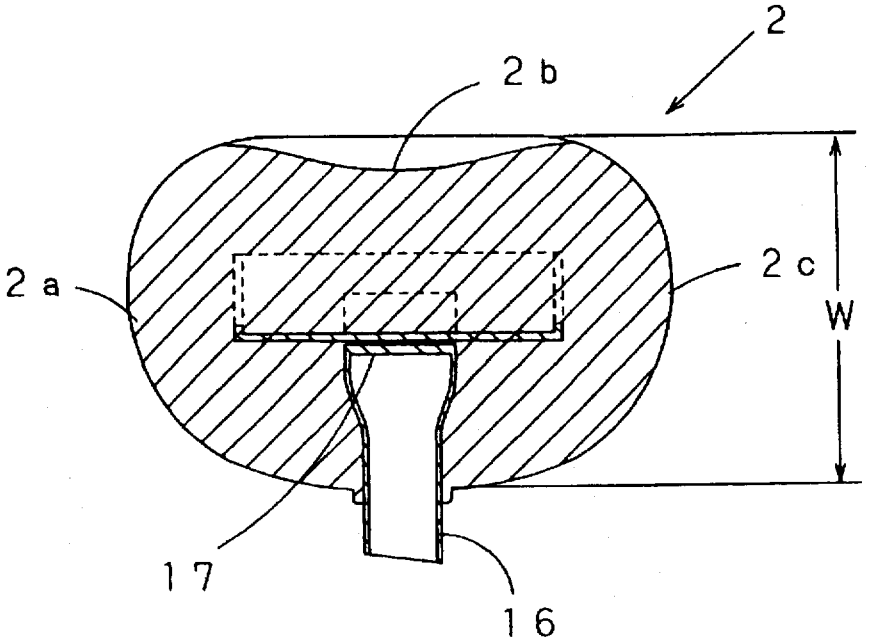
FIG. 21 is an enlarged cross-sectional view of the armpit rest, taken along a line VII—VII of FIG. 18.

As clearly understood from FIGS. 19 to 21, the armpit rest 2 in the sixth embodiment is formed in such a manner that a vertical length or width W thereof is large and a portion 2*b* to be held beneath the shoulder of the user has a substantially triangular cross section, which is shown in FIG. 19. FIG. 20 shows the armpit rest 2 in cross section, as viewed from the upper side thereof. As shown in FIG. 20, a front portion 2*a* and a rear portion 2*c* of the armpit rest 2 are formed to be thick in the lateral direction, and the intermediate portion 2*b* to be held under the armpit is formed to be thin. This is similar to those in the foregoing embodiments. A top end of the inner tube 16 is pressed to be flat. A cover of synthetic resin coated fabric is put on the flat portion of the inner tube 16, prior to injecting urethane foam resin into a space defined by the cover so as to integrally form the armpit rest. Accordingly, also because the crutch main body is made of aluminum alloy, the crutch according to the invention is generally lightweight. In the illustrated embodiment, the whole weight of the crutch is only about 800 g.

With the above-described structures of the walking assistance crutch according to the present invention, the user can use the crutch comfortably without locally being pressed at a portion of his body. When the user falls down by accident, it is possible to keep him from falling on his face against the ground by existence of the walking assistance crutch. Further, the crutch of the invention makes it easy for the user to walk, and impose his weight on the crutch during a rest while he is standing. In addition, the user can hold the crutch easily.

FIGS. 22 to 25 clarify that the walking assistance crutch according to the invention assures more stability in walking than the conventional one.

Figure 22A:
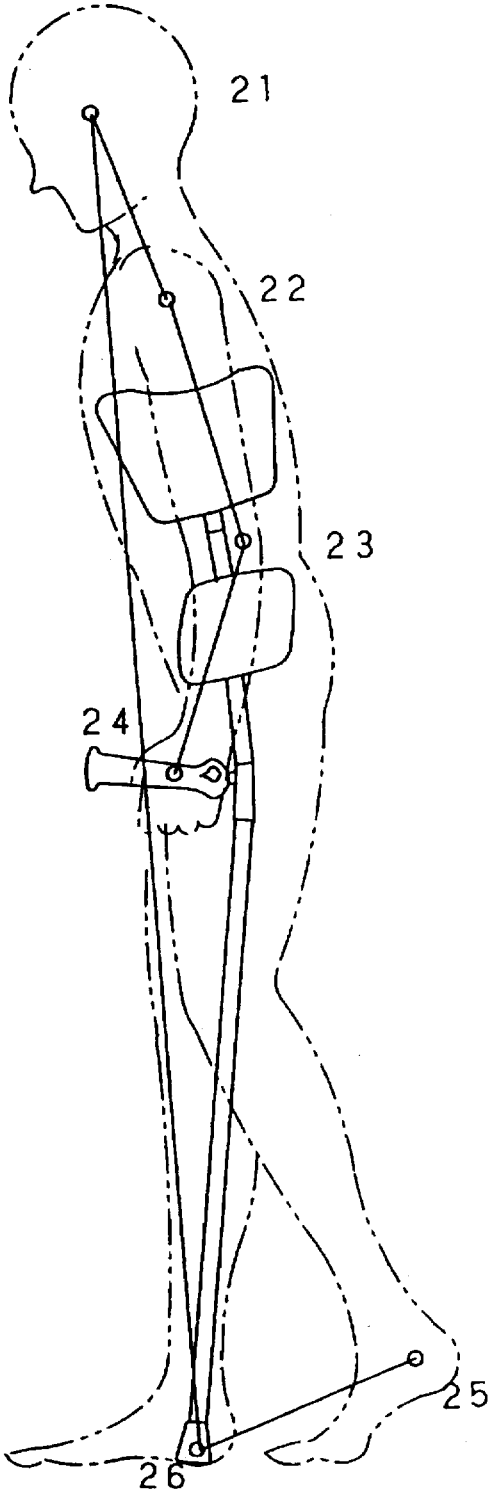
FIGS. 22 and 23 are side elevational views which respectively show a case where a user walks with the crutch according to the invention and a case where a user walks with a conventional crutch.
Figure 22B:
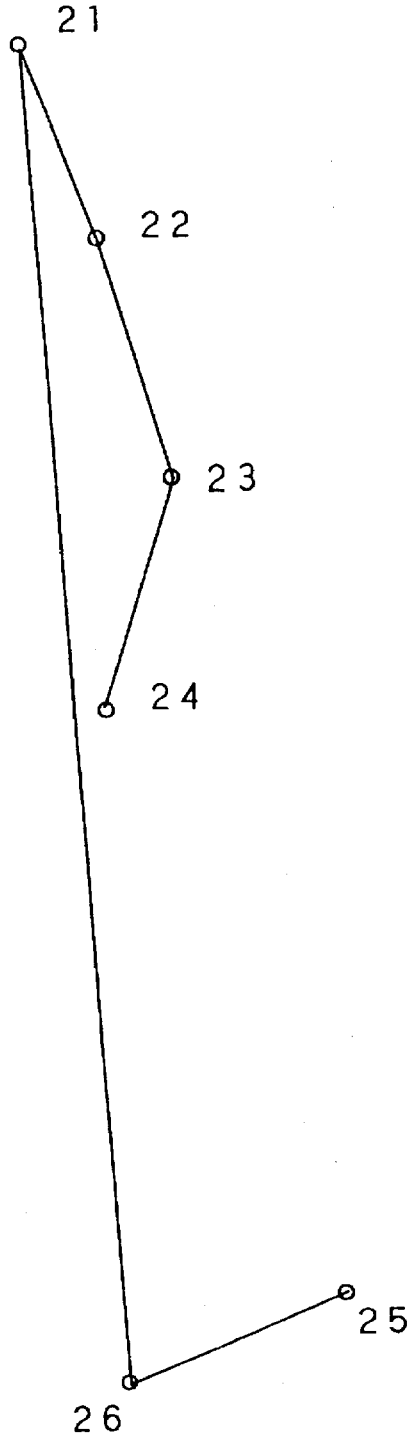
Figure 23A:
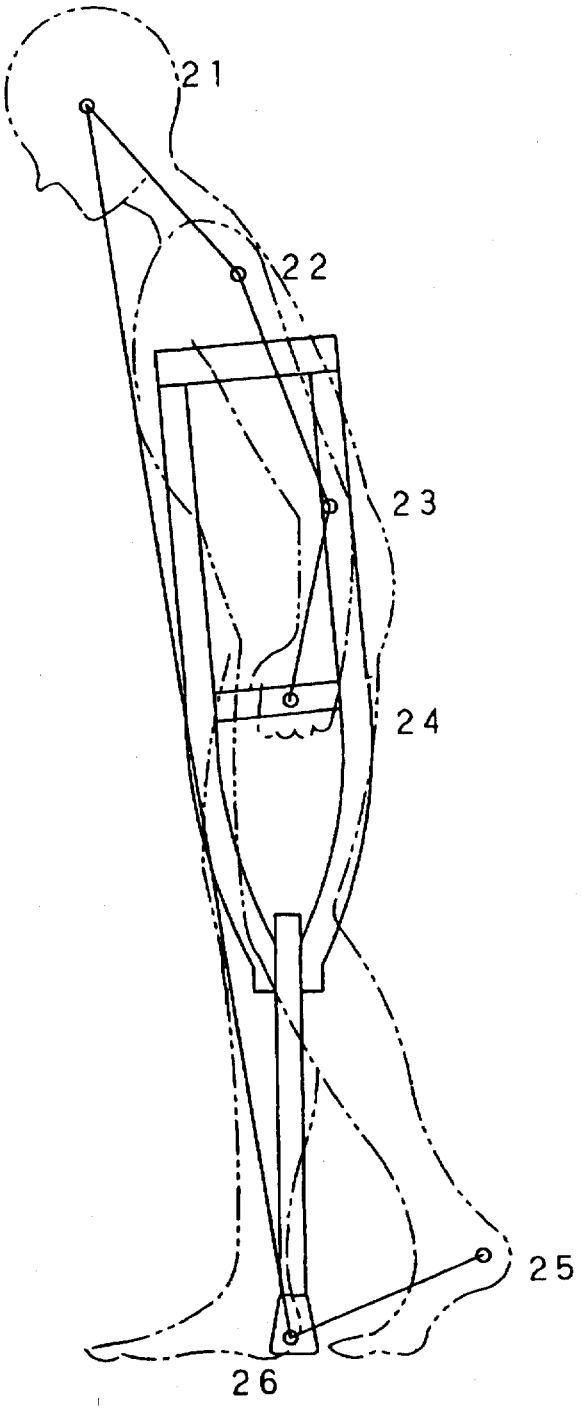
Figure 23B:
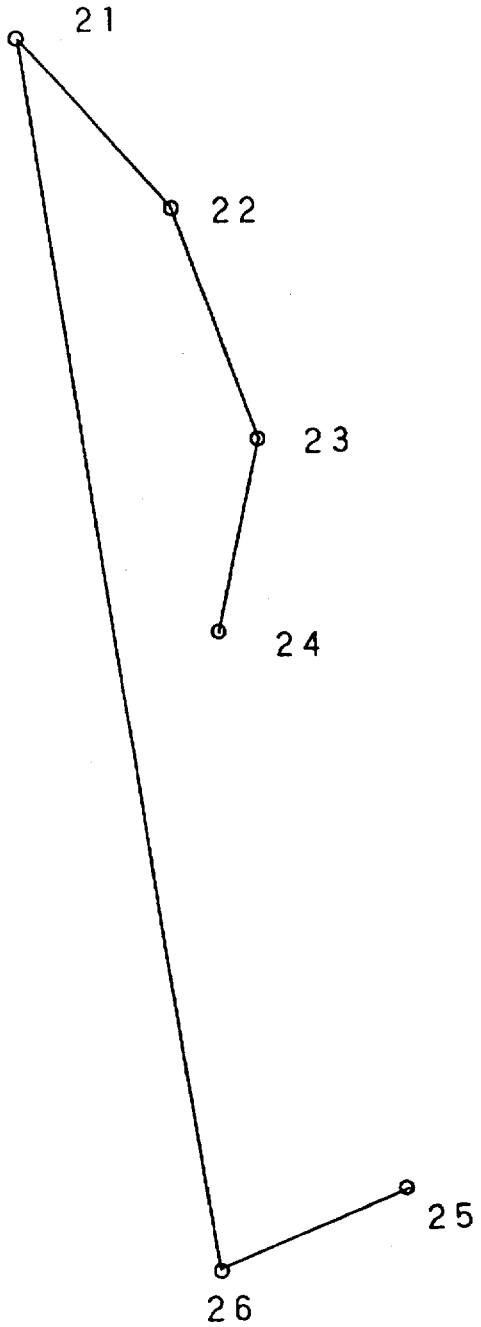
Figure 24:
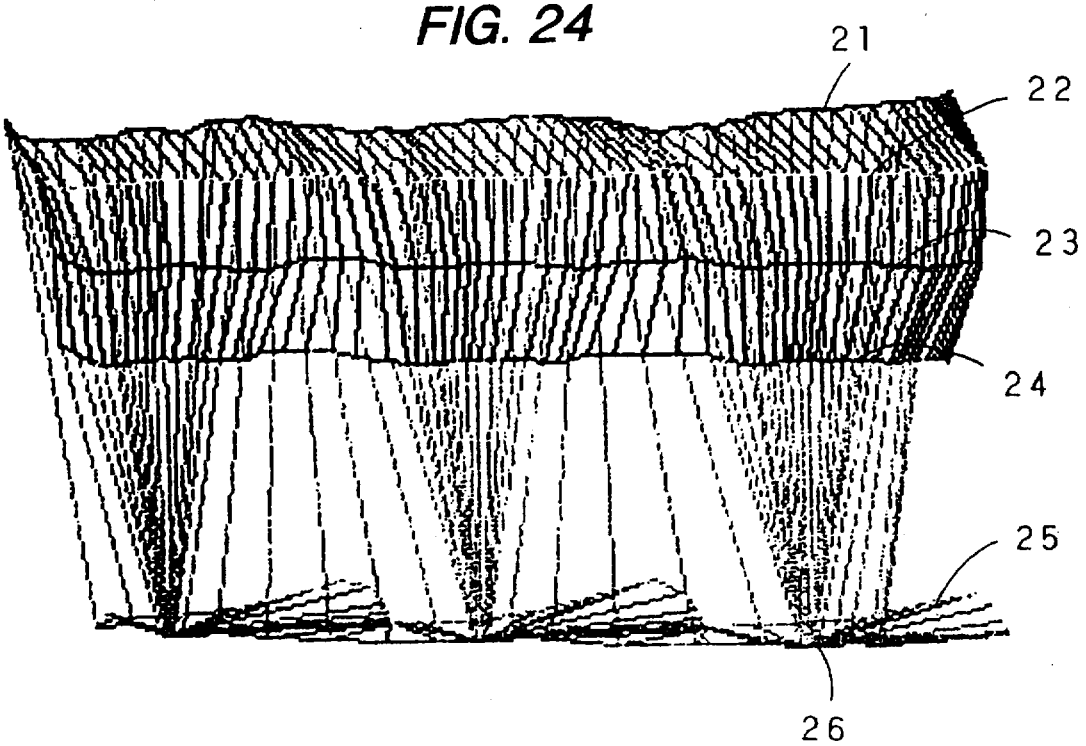
FIGS. 24 and 25 are diagrams which respectively analyze two-dimensional movements in the cases of FIGS. 22 and 23.
Figure 25:
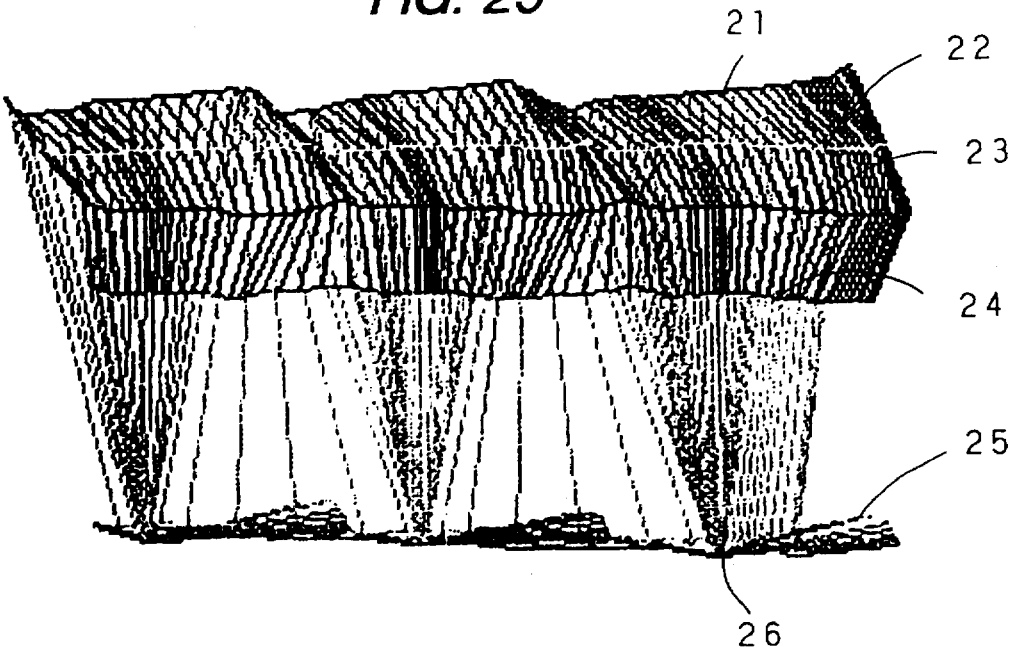

As for a posture of the user when using the crutch of the invention which is illustrated in FIG. 22, a head portion 21, a shoulder portion 22, an elbow portion 23 of the user, a handle portion 24 of the crutch, a heel portion 25 of the user and a foot portion 26 of the crutch are slightly inclined forwardly as a whole. The user can walk in such posture satisfactorily. On the contrary, it is seen from FIG. 23 which illustrates a case of the conventional crutch that the user cannot walk unless he largely leans his body forwardly. FIGS. 24 and 25 are graphs respectively analyzing two-dimensional movements of the above-described portions of the body of the user and the crutch when he is walking with the crutches of the invention and the prior art. Referring to FIGS. 24 and 25,. it is clearly understood that the movements are balanced to be smooth in FIG. 24, whereas in the case of the prior art crutch shown in FIG. 25, the movements are slow at the vertical positions and the head portion 21 moves vertically largely.

As described above, in the walking assistance crutch according to the present invention, the shape of the armpit rest and the positional relationship between the armpit rest and the handle grip can be desirably predetermined so that a moment can be generated which copes with an impedimental portion of a foot and is required depending on impedimental conditions of the user in the longitudinal, lateral and diagonal directions. Therefore, the crutch can be finished to have a shape optimal for the impedimental portion of the user, to thereby suppress pain from occurring to the user during walking.

What is claimed is:

1. A walking assistance crutch comprising a crutch main body including an armpit rest at an upper end of said crutch main body, said armpit rest being of a substantially square shape in side view, a foot portion at a lower end of said crutch main body, and a handle grip at an intermediate portion of said crutch main body, wherein an outer portion of said armpit rest is made of soft material so as to comfortably support a user's arm and side of chest, an intermediate portion of said armpit rest which is held beneath the shoulder of said user is formed to have substantially a triangular cross section when viewed from a front and rear of said armpit rest with an apex of said triangle facing upwardly both side surfaces of said armpit rest are concave to substantially conform to contours of an inner side of an upper arm and a side of a user's chest, and front and rear portions of said armpit rest are formed to have thicknesses larger than said intermediate portion of said armpit rest.

2. A crutch according to claim 1, wherein said handle grip is extended forwardly from a phantom line extending between the armpit rest and the foot portion.

3. A crutch according to claim 1, wherein an upper end of the crutch main body is supported by the armpit rest in such a manner that the crutch main body is pivotable back and forth.

4. A walking assistance crutch comprising a crutch main body including an armpit rest at an upper end of the crutch, said crutch main body being of a substantially square shape in side view, a foot portion at a lower end of said crutch, and a handle grip at an intermediate portion of said crutch, wherein said armpit rest is made of soft material so that said armpit rest comfortably supports a user's arm and body, a thickness of the armpit rest at a bottom portion thereof is larger than that of a thickness at a top portion of the armpit rest and a portion of the armpit rest to be held beneath the shoulder of the user is formed to have a substantially triangular vertical section, and both sides of the armpit rest are formed to have concave surfaces which substantially conform with contours of an inner side of an upper arm and a breast side wall of the user, and front and rear portions of the armpit rest are formed to have thicknesses larger than an intermediate portion of the armpit rest, and said handle grip is extended forwardly from a phantom line extending between the armpit rest and the foot portion.

5. A crutch according to claim 4, wherein said handle grip is extended forwardly from a phantom line extending between the armpit rest and the foot portion.

6. A crutch according to claim 4, wherein an upper end of the crutch main body is pivotally coupled to the armpit rest.

7. A walking assistance crutch comprising a crutch main body including an armpit rest at an upper end of the crutch, said armpit rest being of substantially square shape in side view, a foot portion at a lower end of said crutch, and a handle grip at an intermediate portion of said crutch, and wherein said armpit rest is made of soft material so that the armpit rest comfortably supports a user's arm and body, a thickness of the armpit rest at a bottom portion thereof is larger than that of a thickness at a top portion of the armpit rest and a portion of the armpit rest to be held beneath the shoulder of the user is formed to have concave surfaces which substantially conform with contours of an inner side of an upper arm and a breast side wall of the user, front and rear portions of the armpit rest are formed to have thicknesses larger than an intermediate portion of the armpit rest, said handle grip is extended forwardly from a phantom line extending between the armpit rest and the foot portion, and an upper end of the crutch main body is pivotally coupled to the armpit rest.

8. A walking assistance crutch according to claim 7, further comprising a pad provided on said crutch main body at a position intermediate said armpit rest and said handle grip.

* * * * *